US006070841A

United States Patent [19]

Robinson

[11] Patent Number: 6,070,841

[45] Date of Patent: Jun. 6, 2000

[54] UNIVERSAL SIDEKICK MOUNT BRACKET

[75] Inventor: John W. Robinson, Bloomfield, N.J.

[73] Assignee: Advertising Display Company, Lyndhurst, N.J.

[21] Appl. No.: 09/042,221

[22] Filed: Mar. 13, 1998

[51] Int. Cl.[7] ..... A47B 96/06

[52] U.S. Cl. ..... 248/220.43; 248/222.51; 211/59.1

[58] Field of Search ..... 248/220.22, 220.41, 248/220.43, 220.31, 221.11, 222.51, 225.21, 244; 211/54.1, 57.1, 59.1, 103, 106

[56] References Cited

U.S. PATENT DOCUMENTS

| | | | |
|---|---|---|---|
| 1,714,201 | 5/1929 | West | 211/106 |
| 1,744,382 | 1/1930 | Hensel | 211/106 |
| 2,487,652 | 11/1949 | Heinrich | 211/119.004 |
| 3,037,732 | 6/1962 | Roman | 248/220.43 |
| 3,313,509 | 4/1967 | Lockert | 248/244 |
| 3,973,678 | 8/1976 | Nesbitt | 211/106 |
| 4,327,888 | 5/1982 | Scheneman | 248/221.2 |
| 5,305,898 | 4/1994 | Mel | 211/87 |
| 5,833,077 | 11/1998 | Engel | 211/59.1 |

*Primary Examiner*—Derek J. Berger
*Assistant Examiner*—Gwendolyn Baxter
*Attorney, Agent, or Firm*—Donald R Heiner, Esq.

[57] ABSTRACT

A universal mounting bracket for use on slotted steel shelf standards or slotted steel uprights without the necessity of using tools or additional sub-assembly being required. The universal sidekick mount bracket is of generally triangular shape having one flattened hook end for engaging a slot in the shelf standard or steel upright. The bracket is then rotated toward the standard or upright while, at the same time, applying pressure to a fulcrum or pressure plate which is attached near the lower end of one of the legs of the triangle. Once the bracket is fully rotated a sliding clip disposed about the same leg of the triangle to which the pressure plate is attached engages a slot in the standard or upright thus securing the sidekick mount bracket to the slotted shelf standard or upright. The bracket can now support a hanging display stand.

4 Claims, 5 Drawing Sheets

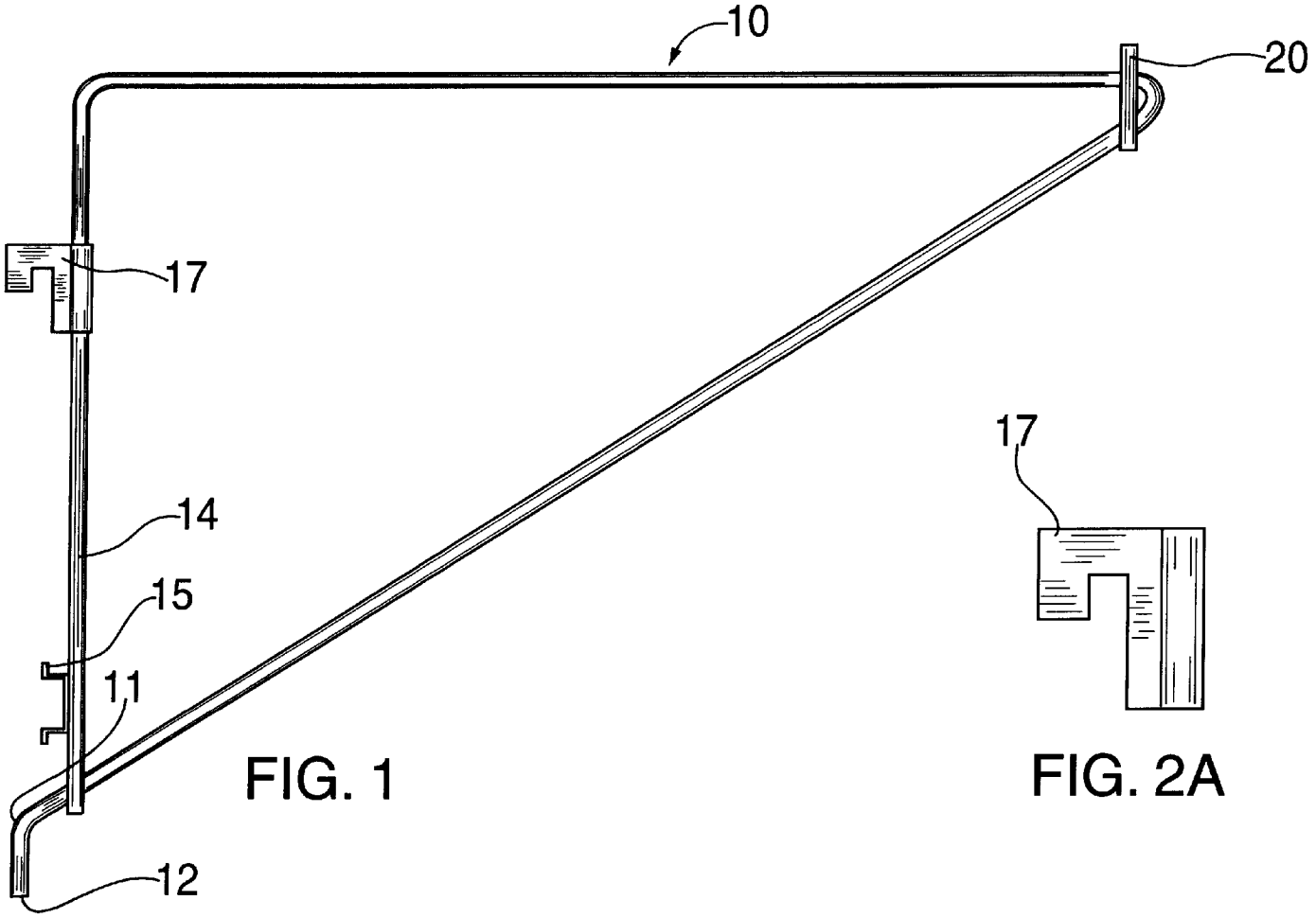
FIG. 1
FIG. 2A
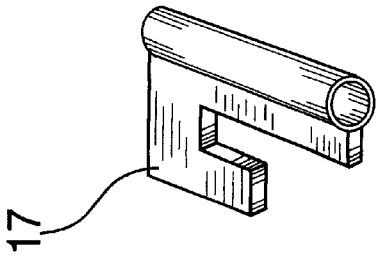
FIG. 2B

UNIVERSAL SIDEKICK MOUNT BRACKET

BACKGROUND OF INVENTION

1. Field of the Invention

The present invention generally involves the field of technology pertaining to a device to be used in conjunction with slotted shelf standards or slotted steel uprights that are used in stores to support, sidekick style, various display devices without the necessity of tools or additional subassembly being required.

There are numerous designs and methods for manufacturing store shelf fixtures which substantially differ from each other but which have in common, a slotted steel upright or shelf standard into which the store shelving plugs.

Heretofore, sidekicks have required a kit for proper installation in the store with the slotted steel upright or shelf standard and wherein the installation kit itself was designed specifically for each such mounting situation. Thus, numerous installation kit designs were required depending upon the particular store shelf fixture.

The instant invention provides a universal mounting bracket for sidekicks for mounting on all slotted shelf standards or slotted steel uprights regardless of the design or method of manufacture.

In essence, the invention relates to a device a hook end of which is inserted into a slot in the shelf standard, rotating the bracket upwardly toward the store fixture standard or upright, simultaneously applying pressure to a fulcrum or pressure plate attached to the mounting bracket and then inserting a sliding clip into a different slot in the fixture standard or upright. The mounting bracket is thus secured to the store slotted shelf standard or slotted steel upright and the display or sidekick can be hung therefrom.

2. Description of the Prior Art

Applicant has been unable to uncover any prior art references, patents or otherwise, which in any way resemble applicant's invention.

SUMMARY OF THE INVENTION

According to the present invention there is provided a mounting location for hanging, sidekick style, a display device in any store fixture environment. That is, one mounting bracket may be utilized in any store which has shelves that are attached to slotted steel uprights or shelf standards without the necessity of using any tools and without the necessity of additional subassembly at the stores being required. The universal sidekick mount bracket of the instant invention comprises a generally triangular shaped display mounting bracket wherein one end of one of the legs of the triangle is flattened such that it will easily slide into a slot in the slotted steel upright or shelf standard into which the store shelving is normally inserted.

Disposed about a different leg of the triangular mounting bracket is a slider clip which can move up or down vertically and parallel to the slotted steel upright or shelf standard. Attached to that same leg of the triangular sidekick mount bracket is a fulcrum or pressure plate which extends generally perpendicular to this same leg and which bears against the shelving standard when the bracket is in place to provide rotational stability to the bracket so that neither the bracket nor the sidekick display mounted thereto can significantly rotate or wobble from side-to-side.

A display stop is attached to a rounded end of the triangular mounting bracket, distant from the slotted steel upright or shelf standard to prevent the hanging display or sidekick from slipping off the end of the bracket after it is installed. Thus, the display must be lifted vertically to be removed from the bracket.

It is, therefore, an object of the present invention to provide a mounting bracket for hanging sidekick style display devices.

It is another object of the invention to provide such a mounting bracket which is triangular in shape.

It is a further object of the invention to provide such a mounting bracket wherein one end of one of the legs of the triangular shaped bracket is flattened for insertion into a slotted steel upright or shelf standard.

It is still a further object of the invention to provide such a mounting bracket further having a slider clip and fulcrum or pressure plate disposed about or attached to one of the other legs of the triangular mounting bracket.

It is still a further object of the invention to provide such a triangular shaped mounting bracket having a display stop wire associated therewith for preventing a hanging display from sliding off the end of such bracket after it is installed.

These and further objects, features, and advantages of the invention shall become apparent from the following detailed description of a preferred embodiment thereof when taken in conjunction with the drawings wherein like reference characters refer to corresponding parts in the several views.

BRIEF DESCRIPTION OF THE DRAWINGS

FIG. 1 is a side elevational view of the triangular shaped sidekick mounting bracket.

FIG. 2A is a side elevational view of a sliding clip which is disposed about one leg of the triangle as shown in FIG. 1.

FIG. 2B is a perspective view of this sliding clip.

DETAILED DESCRIPTION OF THE PREFERRED EMBODIMENT

A universal sidekick mounting bracket for mounting to store shelf slotted standards or steel uprights and for holding sidekick displays after such mounting will now be described with reference to FIGS. 1–4 of the drawings.

Figure 3A:
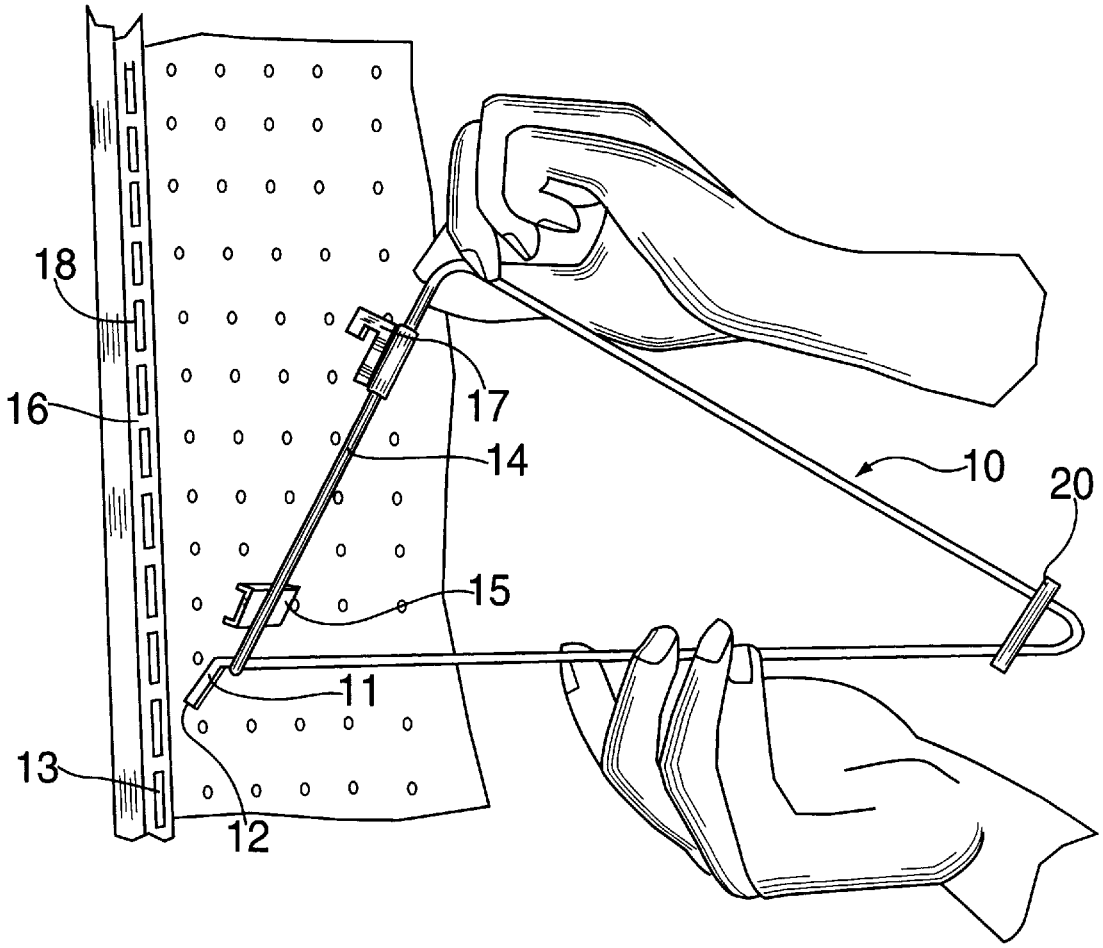
FIGS. 3A and 3B show the triangular mounting bracket being inserted into a slotted steel upright and then being rotated upwardly into position.
Figure 3B:
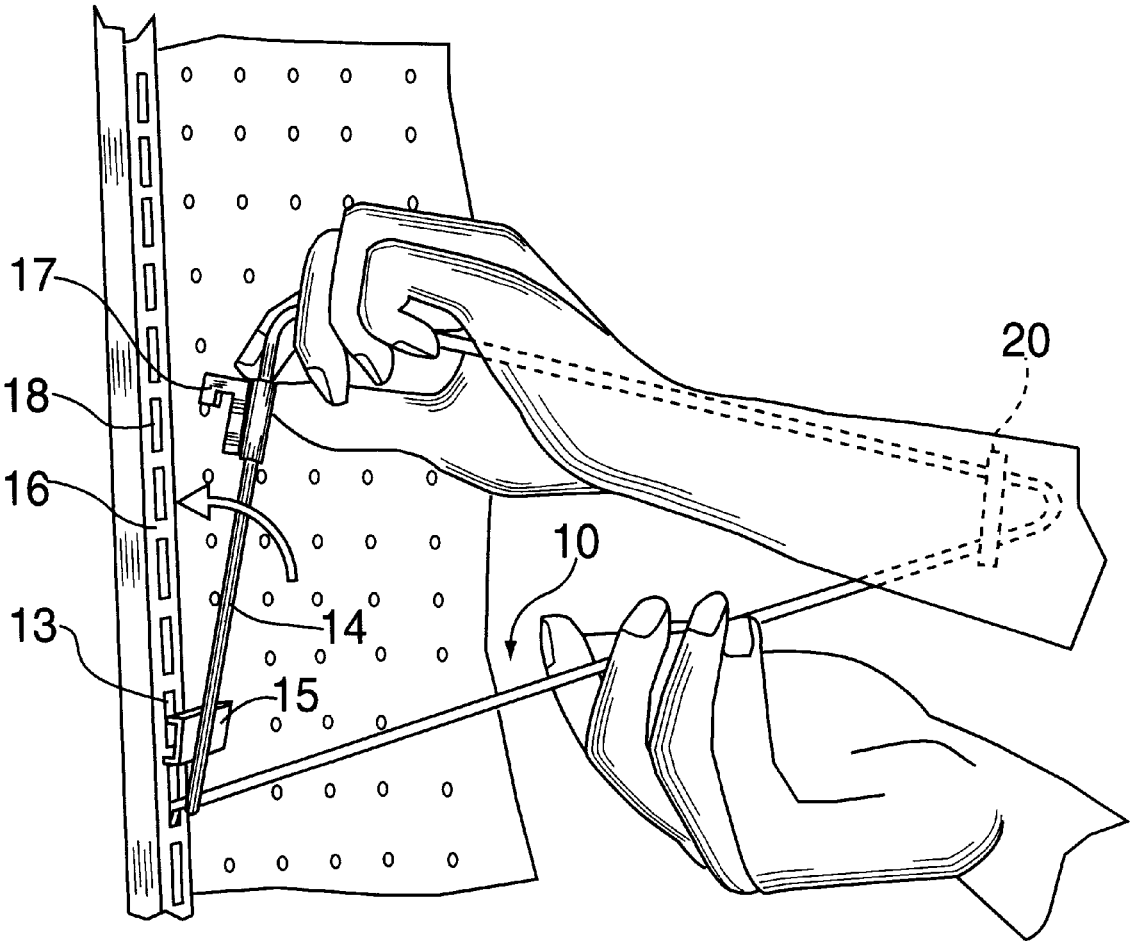
Figure 3C:
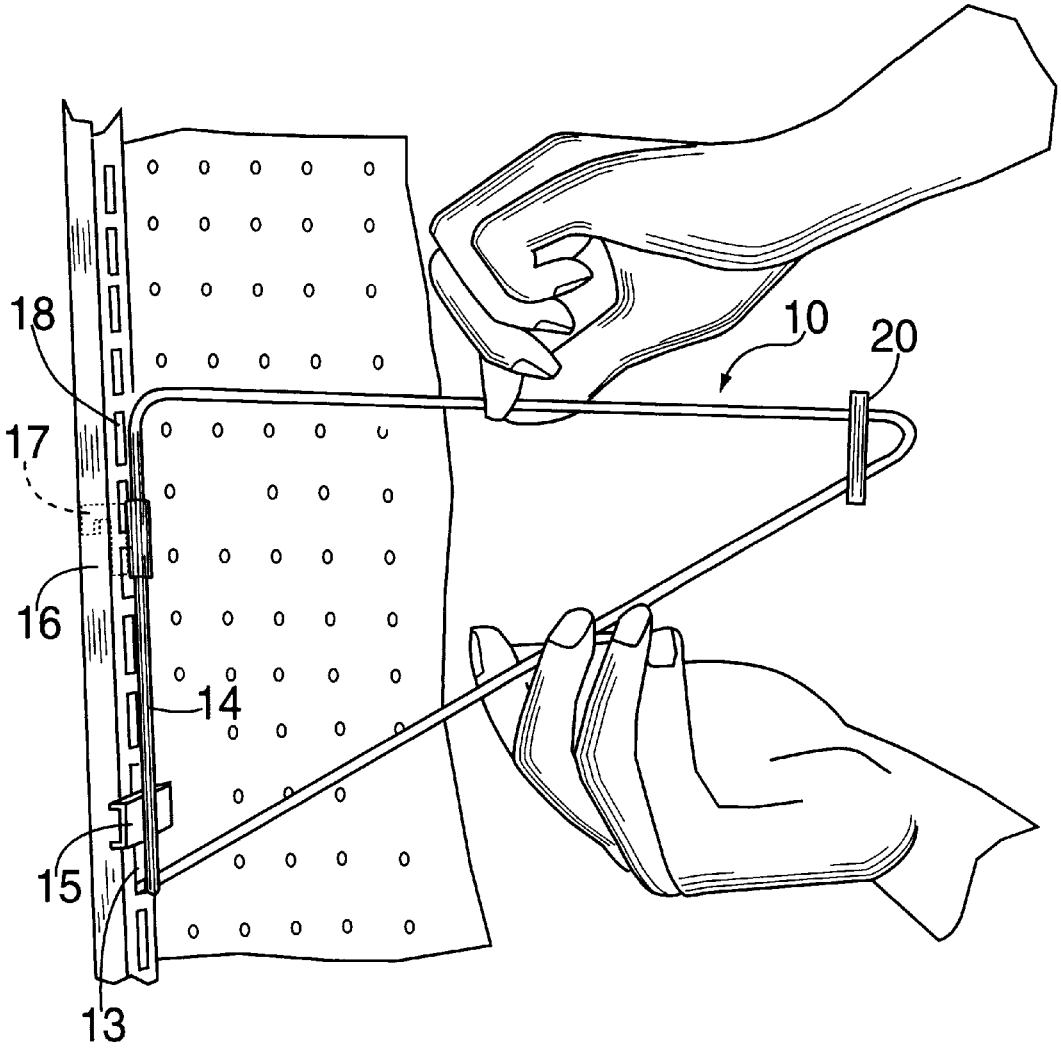
FIG. 3C shows the triangular mounting bracket in place.
Figure 4:
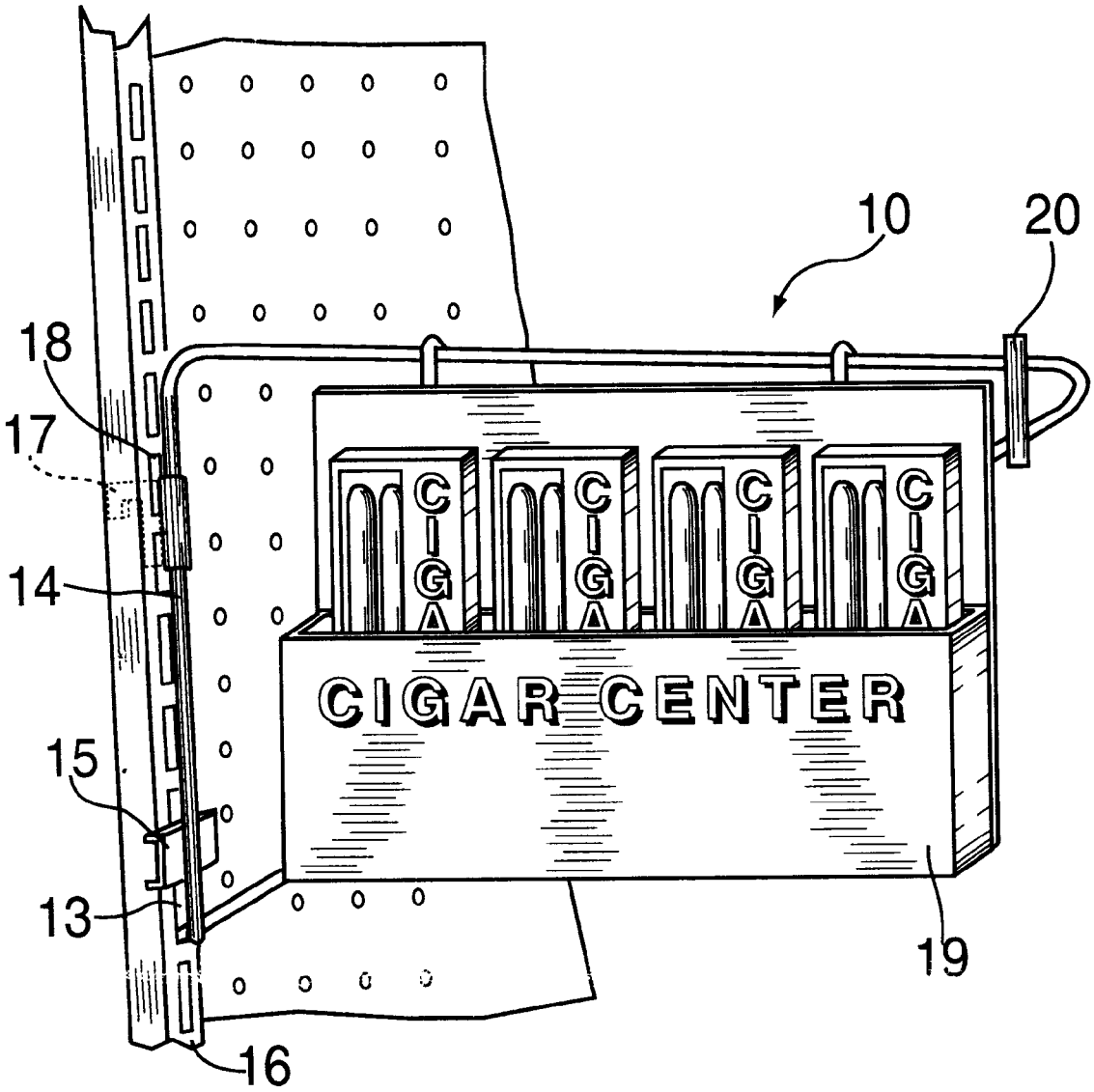
FIG. 4 is the same as FIG. 3 but with a sidekick display unit mounted thereon.

The device itself is shown generally at 10 and is seen to be of generally triangular shape and wherein one of the ends is in the shape of a hook 11 having a flattened end 12 for insertion into a slot 13 of a fixture standard 16 as clearly shown in FIGS. 3B, 3C, and 4.

It should be obvious that this hook 11 and flattened end 12 can be inserted in any of the slots at the desired height for the particular sidekick display to be mounted thereon.

Attached near the lower end of leg 14 of triangular number 10 is a generally "U" shaped pressure plate 15 which, as best seen in FIGS. 3C and 4 bears against the slotted shelf standard 16, when the bracket is fully installed, to provide side-to-side stability such that neither the mounting bracket 10 nor the sidekick display mounted thereon can wobble from side-to-side thereby providing stability to the bracket and display stand.

Disposed about this same leg 14 is a generally "L" shaped sliding clip 17 which can move up or down on leg 14 such that it can engage another slot such as shown at 18 at any suitable height above slot 13. This engagement is as shown in FIGS. 3C and 4.

It should be obvious that the pressure plate does not have to be "U" shaped and the sliding clip 17 does not have to be of generally "L" shape.

Any shape for either of these two items, 15, or 17, that will serve the function stated above may be used.

Once the sidekick display stand 19 is hung from the installed triangular mounting bracket 10 of the instant invention a stop 20 attached by any suitable means across triangular number 10 prevents the display 19 from sliding off mounted bracket 10 unless it is vertically lifted for removal.

In operation, the hook 12 is inserted downwardly into a slot 13 at the desired height and the triangular shaped mounting bracket 10 is then rotated upwardly and essentially counter-clockwise as viewed in FIGS. 3A and 3B while the installer simultaneously applies pressure to pressure plate 15. When the mounting bracket has been fully rotated such that leg 14 is in a vertical position the sliding clip 17 is moved upwardly or downwardly to the desired slot in the shelf standard preferably near the now horizontal arm of mounting bracket 10. A hook on the sliding clip is inserted into the desired slot and slid downwardly until fully engaged in the slot. The sidekick display such as shown at 19 in FIG. 4 can then be hung from the horizontal leg of the mounting bracket.

Previously, such sidekicks have required an installation kit which was usually provided with the sidekick with each installation kit being designed specifically for each different mounting problem. Thus, numerous kit designs were required which then necessitated being sure that the correct kits were collated and packed with the proper sidekick, etc.

The Universal Sidekick Mount Bracket disclosed herein solves this problem by mounting to the slotted shelf standards or slotted steel uprights of every fixture manufacturer that applicant has encountered.

The clip is slidable since the center-to-center spacing of the slots from one fixture manufacturer to the next varies widely.

Though the invention has been described and illustrated with reference to a preferred embodiment thereof, those skilled in the art will appreciate the various changes and modifications in shape, size, composition, and arrangement of parts may be resorted to without departing from the spirit of the invention or scope of the subjoined claims.

What is claimed:

1. An universal sidekick mounting bracket attachable to slotted shelf standards or slotted steel uprights having a plurality of slots formed vertically therein wherein said mounting bracket comprises:

(a) a generally triangular shaped member;

(b) a hook formed at one end of one leg of said triangular shaped member; for engaging a slot formed in said slotted steel upright or shelf standard;

(c) a pressure plate attached to a vertical leg of said triangular shaped member near a lower end thereof for pressing against said slotted steel upright or shelf standard;

(d) a sliding clip slidably disposed about said vertical leg of said triangular shaped member for engaging a second slot formed in said slotted steel upright or shelf standard vertically higher then a first slot; and, (e) stop means attached to said generally triangular shaped member to prevent a display hanging from said triangular shaped member from sliding off an end thereof.

2. The universal sidekick mount bracket of claim 1 wherein said hook has a flattened end for insertion into one of said slots.

3. The universal sidekick mount bracket of claim 1 wherein said pressure plate is of generally "U" shaped and extends perpendicular to said vertical leg of said generally triangular shaped member.

4. The universal sidekick mount bracket of claim 1 wherein said sliding clip is of generally "L" shape having one end insertable into said second slot.

* * * * *